US010309409B2

(12) United States Patent
Nesteroff et al.

(10) Patent No.: US 10,309,409 B2
(45) Date of Patent: Jun. 4, 2019

(54) IMPELLER SHROUD WITH PNEUMATIC PISTON FOR CLEARANCE CONTROL IN A CENTRIFUGAL COMPRESSOR

(71) Applicant: Rolls-Royce Corporation, Indianapolis, IN (US)

(72) Inventors: Michael Nesteroff, Indianapolis, IN (US); Jonathan Acker, Westfield, IN (US); Jeffrey Crutchfield, Indianapolis, IN (US); Nathan Ottow, Indianapolis, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 529 days.

(21) Appl. No.: 15/165,468

(22) Filed: May 26, 2016

(65) Prior Publication Data

US 2017/0343001 A1 Nov. 30, 2017

(51) Int. Cl.

| | |
|---|---|
| ***F04D 29/42*** | (2006.01) |
| ***F04D 29/16*** | (2006.01) |
| ***F04D 29/28*** | (2006.01) |
| ***F04D 29/62*** | (2006.01) |
| *F01D 11/22* | (2006.01) |
| *F01D 11/08* | (2006.01) |

(52) U.S. Cl.

CPC ..... *F04D 29/162* (2013.01); *F04D 29/284* (2013.01); *F04D 29/4206* (2013.01); *F04D 29/622* (2013.01); *F01D 11/08* (2013.01); *F01D 11/22* (2013.01); *F05D 2220/32* (2013.01); *F05D 2260/50* (2013.01)

(58) Field of Classification Search

CPC ..... F01D 11/22; F01D 11/24; F01D 11/20; F01D 11/14; F04D 29/162; F04D 29/622; F04D 29/284; F04D 29/4206; F04D 29/68; F04D 29/681; F04D 27/0246

See application file for complete search history.

(56) References Cited

U.S. PATENT DOCUMENTS

| | | | | |
|---|---|---|---|---|
| 4,264,271 A | | 4/1981 | Libertini | |
| 5,017,088 A | * | 5/1991 | Miraucourt | F01D 11/22 403/28 |
| 6,273,671 B1 | | 8/2001 | Ress, Jr. | |

(Continued)

FOREIGN PATENT DOCUMENTS

WO 2014130159 A1 8/2014

OTHER PUBLICATIONS

European Patent Office, Extended European Search Report for corresponding EP Application No. 17170534 dated Oct. 18, 2017, 7pgs.

*Primary Examiner* — Justin D Seabe
*Assistant Examiner* — Behnoush Haghighian
(74) *Attorney, Agent, or Firm* — Duane Morris LLP

(57) ABSTRACT

A system for controlling the clearance distance between an impeller blade tip of a centrifugal compressor and a radially inner surface of an impeller shroud in a turbine engine. The system comprises a high pressure air source, an air piston mounted between an engine casing and the shroud and adapted to receive high pressure air from the high pressure air source, a mounting arm coupling the shroud and air piston, and a slidable coupling adapted to allow axial movement of the shroud and joining the shroud to an axial member.

19 Claims, 8 Drawing Sheets

(56) References Cited

U.S. PATENT DOCUMENTS

| | | | | |
|---|---|---|---|---|
| 8,087,880 | B2 * | 1/2012 | Karafillis | F01D 11/22 415/1 |
| 9,121,302 | B2 * | 9/2015 | Duong | F01D 11/22 |
| 9,587,507 | B2 * | 3/2017 | Ottow | F04D 29/4206 |
| 2008/0134659 | A1 | 6/2008 | Schwarz et al. | |
| 2011/0002774 | A1 | 1/2011 | Karafillis et al. | |
| 2014/0017600 | A1 | 1/2014 | Brandt et al. | |

* cited by examiner

IMPELLER SHROUD WITH PNEUMATIC PISTON FOR CLEARANCE CONTROL IN A CENTRIFUGAL COMPRESSOR

FIELD OF THE DISCLOSURE

The present invention relates generally to turbine engines having centrifugal compressors and, more specifically, to control of clearances between an impeller and a shroud of a centrifugal compressor.

BACKGROUND

Centrifugal compressors are used in turbine machines such as gas turbine engines to provide high pressure working fluid to a combustor. In some turbine machines, centrifugal compressors are used as the final stage in a multi-stage high-pressure gas generator.

FIG. 1 is a schematic and sectional view of a centrifugal compressor system 100 in a gas turbine engine. One of a plurality of centrifugal compressor blades 112 is illustrated. As blade 112 rotates, it receives working fluid at a first pressure and ejects working fluid at a second pressure which is higher than first pressure. The radially-outward surface of each of the plurality of compressor blades 112 comprises a compressor blade tip 113.

An annular shroud 120 encases the plurality of blades 112 of the impeller. The gap between a radially inner surface 122 of shroud 120 and the impeller blade tips 113 is the blade tip clearance 140 or clearance gap. Shroud 120 may be coupled to a portion of the engine casing 131 directly or via a first mounting flange 133 and second mounting flange 135.

Gas turbine engines having centrifugal compressor systems 100 such as that illustrated in FIG. 1 typically have a blade tip clearance 140 between the blade tips 113 and the shroud 120 set such that a rub between the blade tips 113 and the shroud 120 will not occur at the operating conditions that cause the highest clearance closure. A rub is any impingement of the blade tips 113 on the shroud 120. However, setting the blade tip clearance 140 to avoid blade 112 impingement on the shroud 120 during the highest clearance closure transient may result in a less efficient centrifugal compressor because working fluid is able to flow between the blades 112 and shroud 120 thus bypassing the blades 112 by flowing through gap 140. This working fluid constitutes leakage. In the centrifugal compressor system 100 of FIG. 1, blade tip clearances 140 cannot be adjusted because shroud 120 is rigidly mounted to the engine casing 131.

It is known in the art to dynamically change blade tip clearance 140 to reduce leakage of a working fluid around the blade tips 113. Several actuation systems for adjusting blade tip clearance 140 during engine operation have been developed. These systems often include complicated linkages, contribute significant weight, and/or require a significant amount of power to operate. Thus, there continues to be a demand for advancements in blade clearance technology to minimize blade tip clearance 140 while avoiding rubs.

The present application discloses one or more of the features recited in the appended claims and/or the following features which, alone or in any combination, may comprise patentable subject matter.

SUMMARY

According to an aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; an air piston mounted to said casing, said piston comprising a chamber adapted to receive actuating air and an aft extending mounting arm which moves axially substantially maintaining a radial alignment when said piston is actuated; and an impeller shroud slidably coupled at a forward end to said casing and mounted proximate an aft end to said piston mounting arm, said impeller shroud moving relative to the rotatable centrifugal compressor in an axial direction while substantially maintaining a radial alignment when said piston is actuated.

In some embodiments the air piston chamber is adapted to receive air from the discharge of the rotatable centrifugal compressor. In some embodiments the air piston comprises a forward rigid member mounted at a forward end to said casing, an aft rigid member coupled at an aft end to said mounting arm, and a flexible member coupling said forward and aft rigid members to thereby form said piston chamber. In some embodiments the flexible member comprises a hoop having a U-shaped cross section. In some embodiments the flexible member comprises a bellows forming a hoop. In some embodiments the slidable coupling between said shroud and said casing is dimensioned to maintain an air boundary during the full range of axial movement of said shroud. In some embodiments the compressor shroud assembly further comprises a chamber bounded in part by said casing and at least a portion of the impeller shroud proximate the aft end thereof, said chamber being pressurized by exducer air. In some embodiments the compressor shroud assembly further comprises a chamber bounded in part by said casing and at least a portion of said impeller shroud proximate the forward end thereof, said chamber being pressurized by inducer air. In some embodiments the compressor shroud assembly further comprises one or more sensors for measuring the air pressure in said piston chamber, said piston being actuated or vented in response to the measured pressure in said piston chamber. In some embodiments the compressor shroud assembly further comprises one or more sensors for measuring the clearance gap between said shroud and the rotatable centrifugal compressor, said piston being actuated or vented in response to the clearance gap measure by the one or more sensors.

According to another aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; an air piston mounted to said casing, said piston comprising a chamber adapted to receive actuating air and an aft extending mounting arm which moves axially while substantially maintaining a radial alignment when said piston is actuated; and an impeller shroud mounted at a forward end to said casing and mounted proximate an aft end to said piston mounting arm, said impeller shroud moving relative to the rotatable centrifugal compressor in a cantilevered manner from said forward end thereof when said piston is actuated.

In some embodiments the air piston chamber is adapted to receive air from the discharge of the rotatable centrifugal compressor. In some embodiments the air piston comprises a forward rigid member mounted at a forward end to said casing, an aft rigid member coupled at an aft end to said mounting arm, and a flexible member coupling said forward and aft rigid members to thereby form said piston chamber. In some embodiments the flexible member comprises a hoop having a U-shaped cross section. In some embodiments the flexible member comprises a bellows forming a hoop.

According to an aspect of the present disclosure, a method of dynamically changing a clearance gap between a rotatable centrifugal compressor and a shroud encasing the rotatable centrifugal compressor, said method comprises mounting a pressure-actuated piston to a static casing; mounting a shroud to the piston; and actuating the piston to thereby move the shroud relative to a rotatable centrifugal compressor.

In some embodiments the method further comprises providing air from the discharge of the rotatable centrifugal compressor to actuate the piston. In some embodiments the method further comprises slidably coupling the forward end of the shroud to the casing, wherein the shroud moves relative to the rotatable centrifugal compressor in an axial direction while substantially maintaining a radial alignment when the piston is actuated. In some embodiments the method further comprises sensing the fluid pressure in an actuating chamber of the piston and actuating the piston in response to the sensed fluid pressure. In some embodiments the method further comprises sensing the clearance gap between the rotatable centrifugal compressor and the shroud and actuating the piston in response to the sensed clearance gap.

BRIEF DESCRIPTION OF THE DRAWINGS

The following will be apparent from elements of the figures, which are provided for illustrative purposes and are not necessarily to scale.

Figure 1:
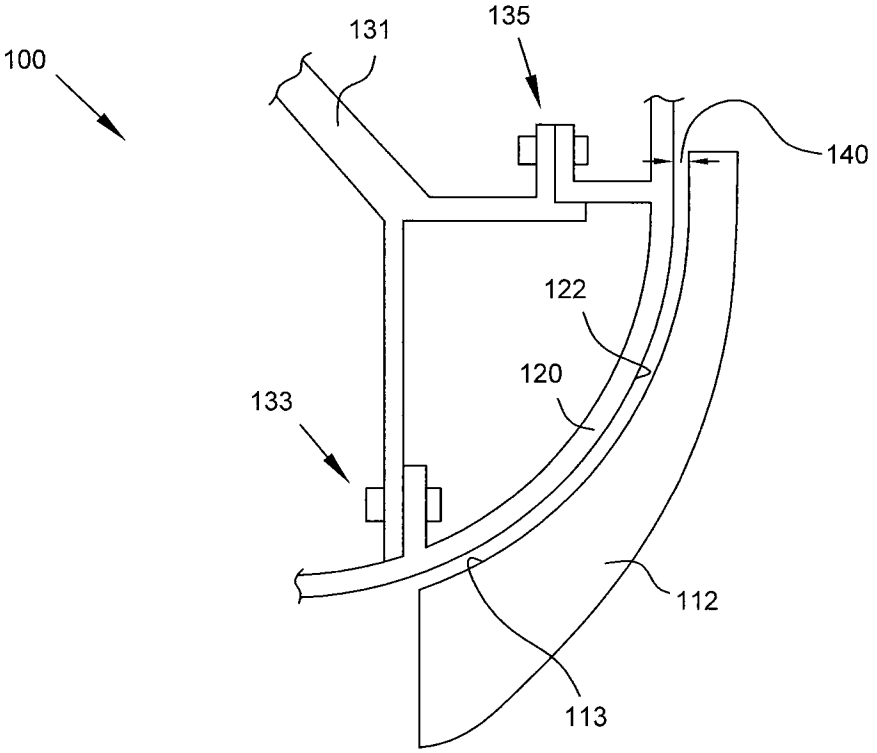
FIG. 1 Prior Art
FIG. 1 is a schematic and sectional view of a centrifugal compressor system in a gas turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in clearance control systems and methods. More specifically, the present disclosure is directed to a system for clearance control of blade tip clearance which avoids the complicated linkages, significant weight penalties, and/or significant power requirements of prior art systems. The present disclosure is directed to a system which supplies high pressure actuating air to an air piston to cause axial deflection of an impeller shroud.

Figure 2A:
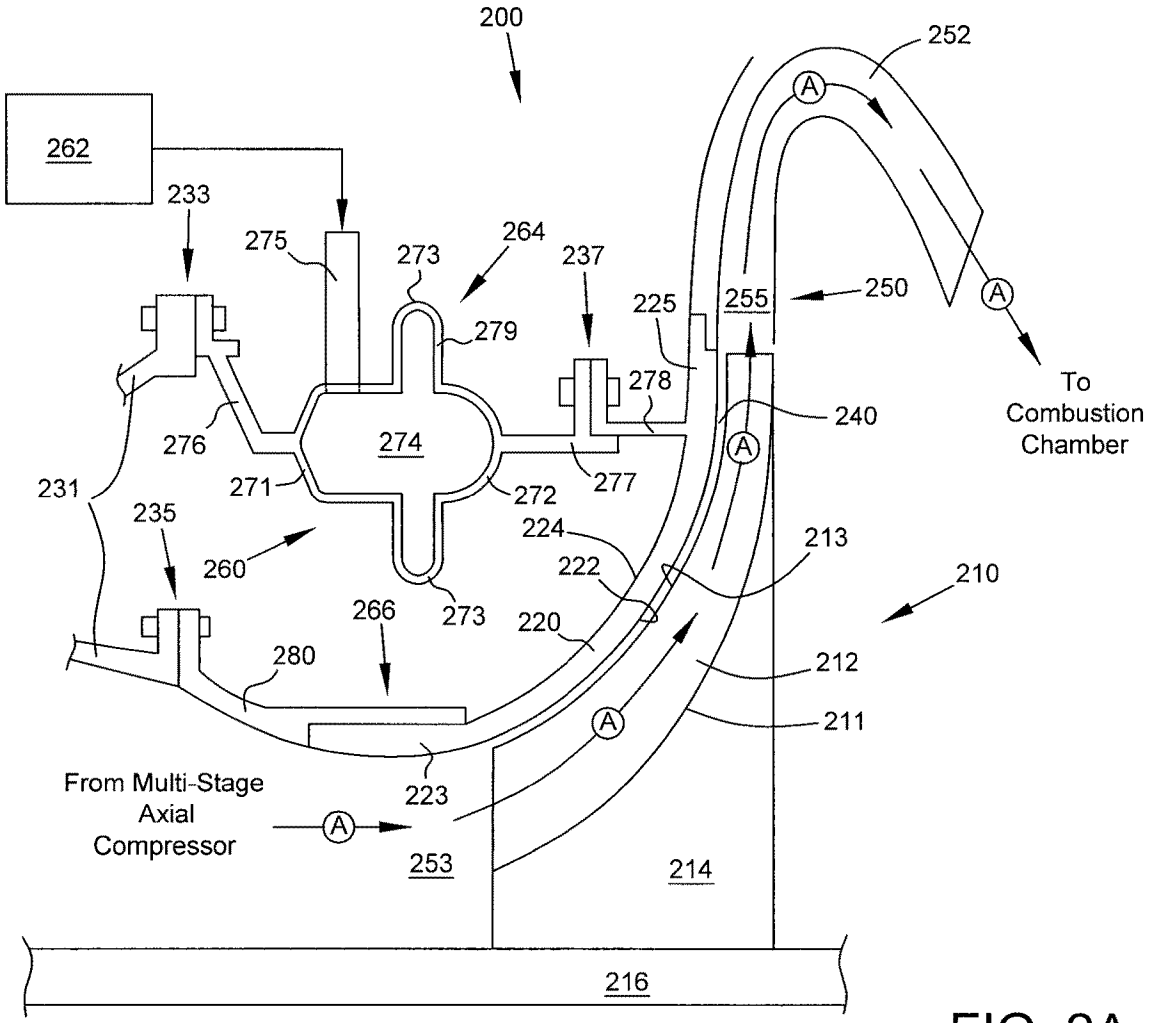
FIG. 2A is a schematic and sectional view of a centrifugal compressor system having a clearance control system in accordance with some embodiments of the present disclosure.

FIG. 2A is a schematic and sectional view of a centrifugal compressor system 200 having a clearance control system 260 in accordance with some embodiments of the present disclosure. Centrifugal compressor system 200 comprises centrifugal compressor 210 and clearance control system 260.

The centrifugal compressor 210 comprises an annular impeller 211 having a plurality of centrifugal compressor blades 212 extending radially from the impeller 211. The impeller 211 is coupled to a disc rotor 214 which is in turn coupled to a shaft 216. Shaft 216 is rotatably supported by at least forward and aft shaft bearings (not shown) and may rotate at high speeds. The radially-outward surface of each of the compressor blades 212 constitutes a compressor blade tip 213.

As blade 212 rotates, it receives working fluid at an inlet pressure and ejects working fluid at a discharge pressure which is higher than the inlet pressure. Working fluid (e.g. air in a gas turbine engine) is typically discharged from a multi-stage axial compressor (not shown) prior to entering the centrifugal compressor 210. Arrows A illustrate the flow of working fluid through the centrifugal compressor 210. Working fluid enters the centrifugal compressor 210 from an axially forward position 253 at an inlet pressure. Working fluid exits the centrifugal compressor 210 at an axially aft and radially outward position 255 at a discharge pressure which is higher than inlet pressure.

Working fluid exiting the centrifugal compressor 210 passes through a diffusing region 250 and then through a deswirl cascade 252 prior to entering a combustion chamber (not shown). In the combustion chamber, the high pressure working fluid is mixed with fuel and ignited, creating combustion gases that flow through a turbine (not shown) for work extraction.

In one embodiment, the clearance control system 260 comprises a high pressure air source 262, an air piston 264, an annular shroud 220, and a slidable coupling 266. Clearance control system 260 can also be referred to as a compressor shroud assembly.

High pressure air source 262 provides high pressure actuating air to air piston 264. In some embodiments high pressure air source 262 is supplied from centrifugal compressor discharge air.

Air piston 264 is adapted to receive high pressure air from high pressure air source 262. Air piston 264 comprises a forward rigid member 271, aft rigid member 272, and a central flex member 273 disposed between forward rigid member 271 and aft rigid member 272. Together, forward rigid member 271, aft rigid member 272, and central flex member 273 define a piston chamber 274.

Figure 2B:
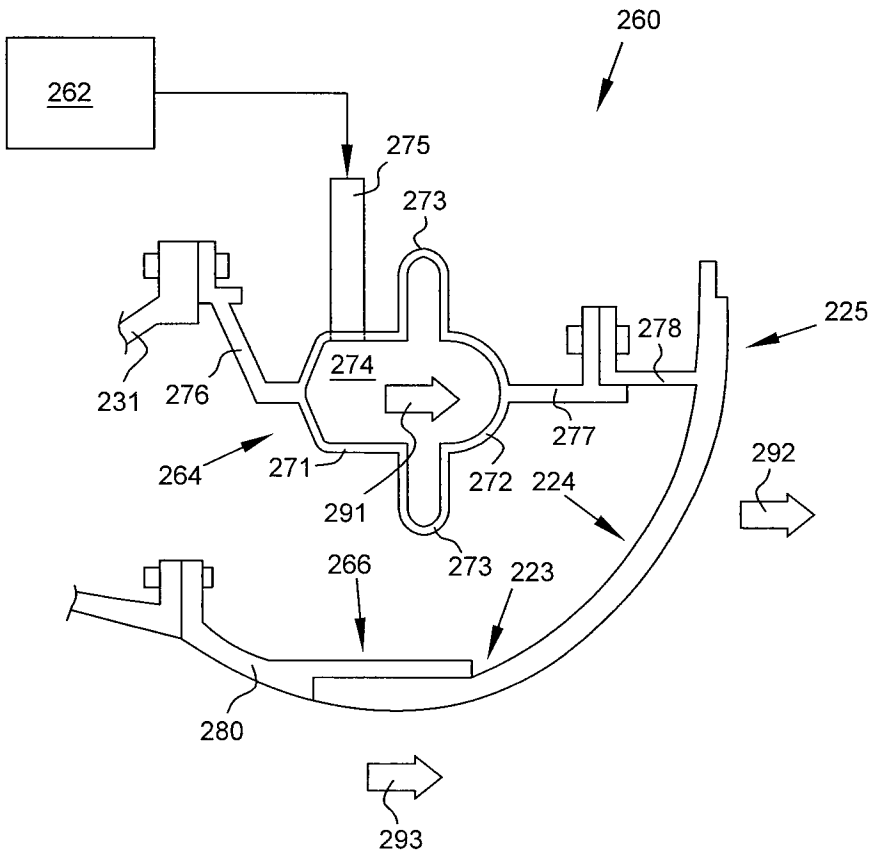
FIG. 2B is an enlarged schematic and sectional view of the clearance control system illustrated in FIG. 2A, in accordance with some embodiments of the present disclosure.

In some embodiments, as illustrated in FIGS. 2A and 2B, central flex member 273 comprises a ring 279 or hoop having a U-shaped cross section which extends radially outward from forward rigid member 271 and aft rigid member 272 and adapted to expand, contract, or flex primarily in an axial direction. In other words, expansion and contraction of air piston 264 results in axial movement while substantially maintaining a radial alignment.

In some embodiments high pressure air is received from high pressure air source 262 via a receiving chamber 275 which is in fluid communication with piston chamber 274. In some embodiments receiving chamber 275 includes a regulating valve which regulates movement of high pressure air into and out of piston chamber 274. In some embodiments receiving chamber 275 further includes a member for venting piston chamber 274 to atmospheric pressure or to a pressure which is lower than that of piston chamber 274.

Air piston 264 is axially disposed between a portion of engine casing 231 and shroud 220. A forward-extending arm 276 extends axially forward from forward rigid portion 271 and is coupled to engine casing 231 at first mounting flange 233, thus mounting air piston 264 to the casing 231. An aft-extending arm 277 extends axially aft from aft rigid portion 272 and is coupled to a mounting arm 278 extending axially forward from shroud 220. Aft-extending arm 277 and mounting arm 278 are coupled at mounting flange 237.

In some embodiments air piston 264 is an annular piston. In other embodiments, a plurality of discrete air pistons 264 are circumferentially disposed about shroud 220 and each act independently upon the shroud 220.

Shroud 220 is a dynamically moveable impeller shroud. Shroud 220 encases the plurality of blades 212 of the centrifugal compressor 210. Shroud 220 comprises a forward end portion 223 terminating at slidable coupling 266, a central portion 224, and a aft end portion 225. In some embodiments, surface 222 of shroud 220 comprises an abradable surface. In some embodiments, a replaceable cover is provided which covers the surface 222 and is replaced during engine maintenance due to impingement of blade tips 213 against surface 222.

In some embodiments aft end portion 225 is defined as the radially outward most third of shroud 220. In other embodiments aft end portion 225 is defined as the radially outward most quarter of shroud 220. In still further embodiments aft end portion 225 is defined as the radially outward most tenth of shroud 220. In embodiments wherein mounting arm 278 extends axially forward from aft end portion 225, these various definitions of aft end portion 225 as either the final third, quarter, or tenth of shroud 220 provide for the various radial placements of mounting arm 278 relative to shroud 220.

Slidable coupling 266 comprises an axial member 280 coupled to forward end portion 223 of shroud 220. Slidable coupling 266 is adapted to allow sliding displacement between axial member 280 and forward end portion 223. In some embodiments one or more surfaces of forward end portion 223 and/or axial member 280 comprise a lubricating surface to reduce friction and wear between these components. In some embodiments the lubricating surface is a coating.

Clearance control system 260 is coupled to the engine casing 231 via a first mounting flange 233 and second mounting flange 235. In some embodiments engine casing 231 is at least a portion of a casing around the multi-stage axial compressor.

The gap between a surface 222 of shroud 220 which faces the impeller 211 and the impeller blade tips 213 is the blade tip clearance 240. In operation, thermal, mechanical, and pressure forces act on the various components of the centrifugal compressor system 200 causing variation in the blade tip clearance 240. For most operating conditions, the blade tip clearance 240 is larger than desirable for the most efficient operation of the centrifugal compressor 210. These relatively large clearances 240 avoid rubbing between blade tip 213 and the surface 222 of shroud 220, but also result in high leakage rates of working fluid past the impeller 211. It is therefore desirable to control the blade tip clearance 240 over a wide range of steady state and transient operating conditions. The disclosed clearance control system 260 provides blade tip clearance 240 control by positioning shroud 220 relative to blade tips 213.

Figure 7:
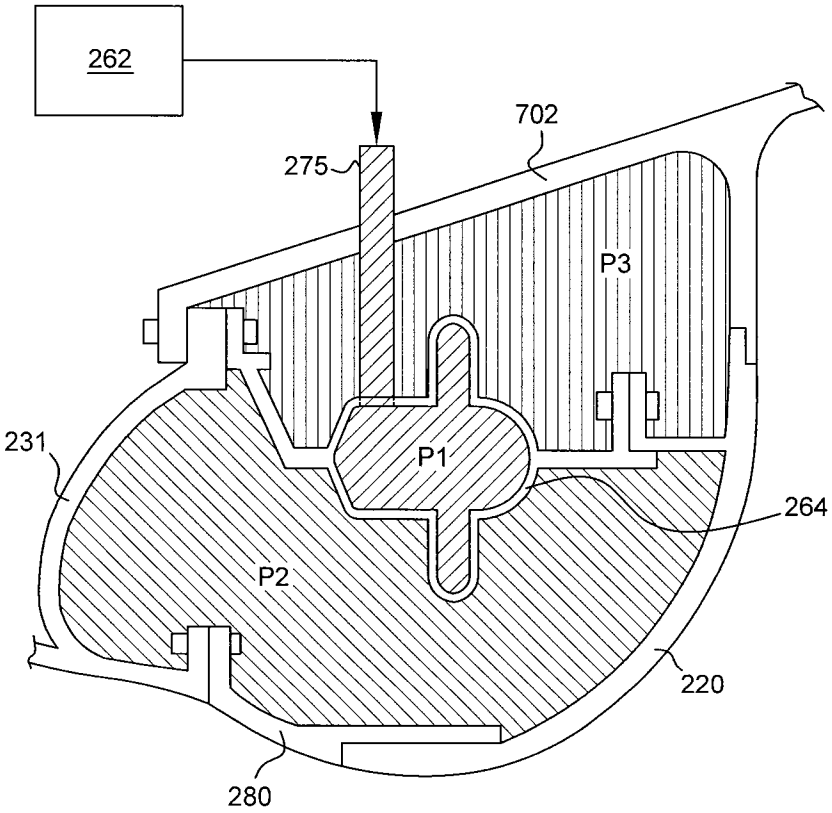
FIG. 7 is a schematic and sectional view of the pressure regions of a clearance control system in accordance with some embodiments of the present disclosure.

FIG. 7 is a schematic and sectional view of the pressure regions P1, P2, and P3 of a clearance control system 260 in accordance with some embodiments of the present disclosure. A first pressure region P1 is defined as piston chamber 274 and receiving member 275. A second pressure region P2 is disposed radially inward from air piston 264 and radially outward from shroud 220 and axial member 280. A third pressure region P3 is disposed radially outward from air piston 264 and radially inward from a casing arm 702.

In some embodiments, second pressure region P2 and third pressure region P3 are maintained at or near atmospheric pressure, meaning that regions P2 and P3 are neither sealed nor pressurized. First pressure region P1 receives high pressure air from high pressure air source 262, which in some embodiments is compressor discharge air. However, in such an embodiment, a relatively large piston chamber 274 is required to overcome the large differential pressure across the shroud 220 (i.e. differential pressure between the pressure of regions P2 and P3 and the pressure of the centrifugal compressor 210. In other words, the large differential pressure makes it more difficult to deflect or cause axial movement in shroud 220, thus requiring a larger air piston 264 to perform the work.

Thus in other embodiments second pressure region P2 and third pressure region P3 are sealed and pressurized to reduce the differential pressure across the shroud 220. For example, in some embodiments second pressure region P2 and third pressure region P3 are pressurized using one of inducer air, exducer air, or intermediate stage compressor air. Supplying compressor discharge air to piston chamber 274 still creates a differential pressure across the air piston 264 that causes axial deflection, but the force required to move shroud 220 is greatly reduced due to the lower differential pressure across the shroud 220.

In embodiments with second pressure region P2 sealed and pressurized using inducer air and third pressure region P3 sealed and pressurized using exducer air, the selection of the location of mounting arm 278 between forward end 223 and aft end 225 is significant because a greater exposure of shroud 220 to exducer pressure results in less work required by the the air piston 264 to move shroud 220. In addition, it can be undesirable to locate mounting arm 278 adjacent to aft end 225 due to the risk that the air piston 264 will overly bend the upper tip of shroud 220.

In some embodiments second pressure region P2 and third pressure region P3 are merged as a single, sealed pressure region and are thus pressurized at equal pressures.

FIG. 2B is an enlarged schematic and sectional view of the clearance control system 260 illustrated in FIG. 2A, in accordance with some embodiments of the present disclosure. The operation of clearance control system 260 will be discussed with reference to FIG. 2B.

In some embodiments during operation of centrifugal compressor 210 blade tip clearance 240 is monitored by periodic or continuous measurement of the distance between surface 222 and blade tips 213 using a sensor or sensors positioned at selected points along the length of surface 222. When clearance 240 is larger than a predetermined threshold, it may be desirable to reduce the clearance 240 to prevent leakage and thus improve centrifugal compressor efficiency. Pressure inside the piston chamber 274 may be adjusted based on measured blade tip clearance 240 to move shroud 220 and thus adjust the blade tip clearance 240 as desired.

In other embodiments, engine testing may be performed to determine blade tip clearance 240 for various operating parameters and a piston chamber 274 pressure schedule is developed for different modes of operation. For example, based on clearance 240 testing, piston chamber 274 pressures may be predetermined for cold engine start-up, warm engine start-up, steady state operation, and max power operation conditions. As another example, a table may be created based on blade tip clearance 240 testing, and piston chamber 274 pressure is adjusted according to operating temperatures and pressures of the centrifugal compressor 210. A sensor may be used to monitor pressure in piston chamber 274. Thus, based on monitoring the operating conditions of the centrifugal compressor 210 such as inlet pressure, discharge pressure, and/or working fluid temperature, a desired blade tip clearance 240 is achieved according to a predetermined schedule of pressures for piston chamber 274.

Regardless of whether clearance 240 is actively monitored or controlled via a schedule, in some operating conditions it may be desirable to reduce the clearance in order to reduce leakage past the centrifugal compressor 210. In order to reduce the clearance 240, high pressure gas is supplied by high pressure gas source 262 to piston chamber 274. Piston chamber 274 expands between forward rigid member 271 and aft rigid member 272 due to the admission of high pressure gas. Central flex member 273 enables this expansion in an axial direction. With air piston 264 rigidly coupled, or "grounded", to casing 231 via forward-extending arm 276, expansion of the air piston 264 is enabled in the axially aft direction as indicated by arrow 291 in FIG. 2B.

The axially aft expansion of air piston 264 displaces aft-extending arm 277 and mounting arm 278. Mounting arm 278 is coupled to and imparts a force on the aft end portion 225 of shroud 220, thus moving the aft end portion 225 in an axially aft direction as indicated by arrow 292. This movement of aft end portion 225 is translated to a similar axially aft movement at the slidable coupling 266, where forward end portion 223 is displaced in an axially aft direction relative to axial member 280 as indicated by arrow 293. Additionally, as discussed with reference to FIG. 7, the application of air pressure at third pressure region P3 imparts a force on aft end portion 225. Shroud 220 thus moves relative to the centrifugal compressor 210 in an axial direction while substantially maintaining the radial alignment of shroud 220.

The axially aft movement of shroud 220 caused by air piston 264 expansion results in shroud 220 moving closer to blade tips 213, thus reducing the clearance 240 and leakage. During many operating conditions this deflection of shroud 220 in the direction of blade tips 213 is desirable to reduce leakage and increase compressor efficiency.

Where monitoring of blade tip clearance 240 indicates the need for an increase in the clearance 240, high pressure air is bled from piston chamber 274. As piston chamber 274 contracts, central flex member 273 enables the contraction to be primarily in the axial direction, resulting in axially forward movement of aft-extending arm 277, mounting arm 278, and aft end portion 225. The axially forward movement of aft end portion 225 results in similar movement of shroud 220, including the sliding displacement in an axially forward direction of forward end portion 223 against axial member 280. Thus, by bleeding air from piston chamber 274 shroud 220 is moved axially forward, away from blade tips 213 and increasing blade tip clearance 240. Slidable coupling 266 is dimensioned such that an air boundary is maintained through the full range of axial movement of shroud 220.

Figure 3:
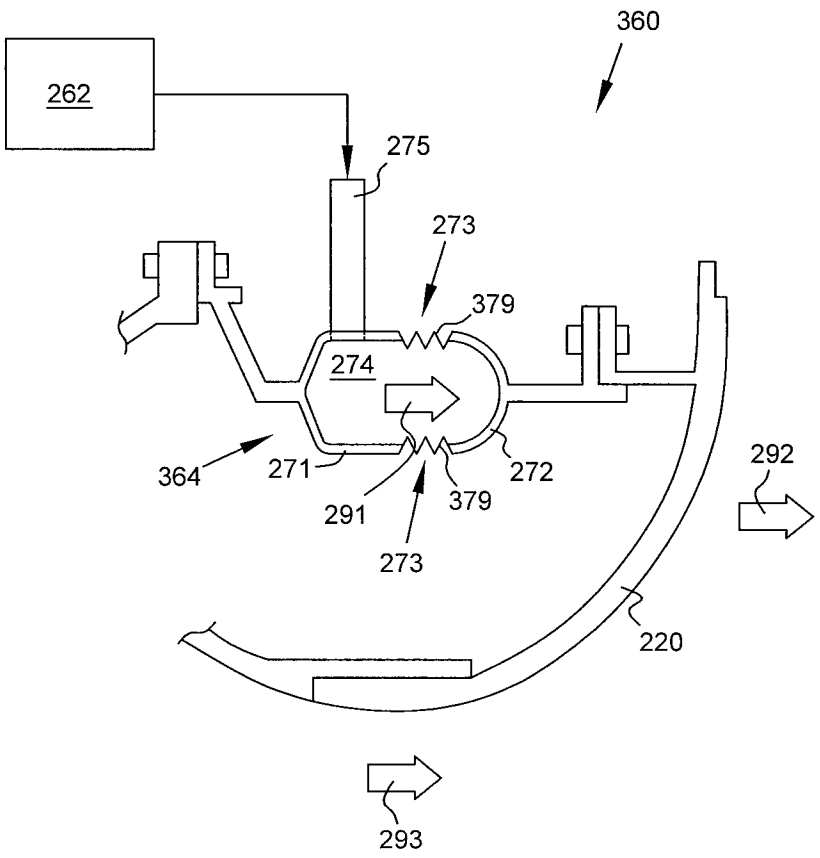
FIG. 3 is a schematic and sectional view of another embodiment of a clearance control system with a bellows-type air piston in accordance with the present disclosure.

FIG. 3 is a schematic and sectional view of another embodiment of a clearance control system 360 with a bellows-type air piston 364 in accordance with the present disclosure. The clearance control system 360 illustrated in FIG. 3 is substantially similar to the clearance control system 260 illustrated in FIG. 2. Air piston 364 comprises a bellows 379 as central flex member 273 forming a hoop disposed between forward rigid member 271 and aft rigid member 272. Like flexible protrusion 279, bellows 379 is adapted to expand, contract, or flex primarily in an axial direction. The operation of clearance control system 360 is substantially the same as the operation of clearance control system 260 as described above. Bellows 379 is interchangeable with flexible protrusion 279, and central flex member 273 can take many forms.

Figure 5:
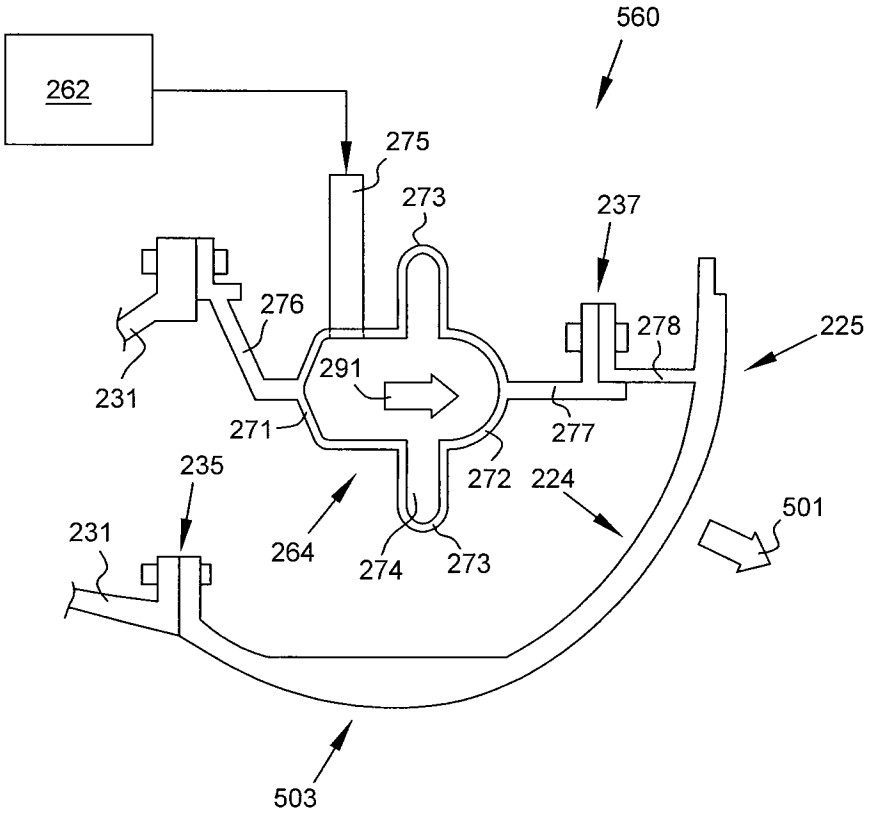
FIG. 5 is a schematic and sectional view of another embodiment of a clearance control system in accordance with the present disclosure.

FIG. 5 is a schematic and sectional view of another embodiment of a clearance control system 560 in accordance with the present disclosure. Clearance control system 560 includes shroud 220 which comprises an extended forward end portion 503, central portion 224, and aft end portion 225. Extended forward end portion 503 is coupled to casing 231 at mounting flange 235. Supplying high pressure air to piston chamber 274 results axial expansion of air piston 264, which in turn causes an axially aft movement of mounting arm 278. Shroud 220 flexes in an axially aft and radially inward direction as indicated with arrow 501, toward the blade 212. Thus the embodiment of FIG. 5 illustrates a shroud 220 which is more rigidly coupled to casing 231 and which deflects in a radially inward and axially aft direction as indicated by arrow 501. Evacuation of air from piston chamber 274 results in contraction of the air piston 264, axially forward movement of mounting arm 278, and a radially outward and axially forward deflection of shroud 220.

Figure 4:
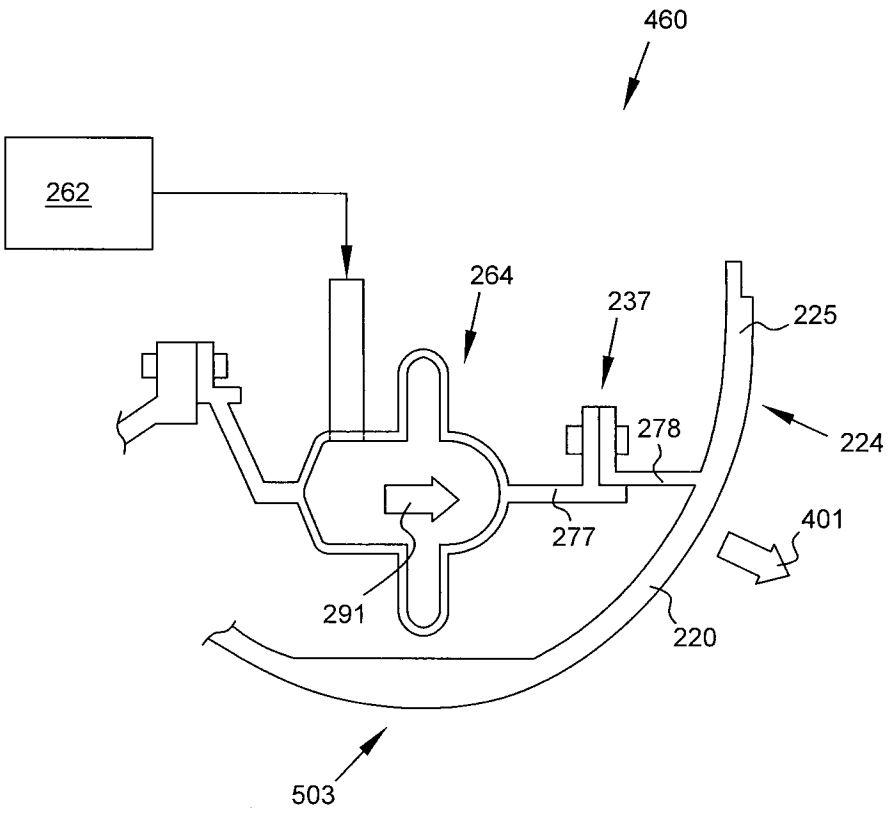
FIG. 4 is a schematic and sectional view of another embodiment of a clearance control system in accordance with the present disclosure.

FIG. 4 is a schematic and sectional view of another embodiment of a clearance control system 460 with a modified mounting arm 278 placement in accordance with the present disclosure. In the embodiment of FIG. 4, mounting arm 278 is coupled to shroud 220 at central portion 224. As in the embodiment of FIG. 5, shroud 220 which comprises an extended forward end portion 503, central portion 224, and aft end portion 225. Extended forward end portion 503 is coupled to casing 231 at mounting flange 235.

Axial expansion of air piston 264 caused by supplying high pressure air to piston chamber 274 results in axially aft movement of mounting arm 278. In the embodiment of FIG. 4 the central placement of mounting arm 278 results in different response and deflection characteristics along the shroud 220 and a different force required in order to effect axial movement of the shroud 220. With the shroud 220 anchored by extended forward portion 503, the axially aft motion of mounting flange 278 results in shroud 220 moving in an axially aft and radially inward direction as indicated by arrow 401.

In some embodiments central portion 224 is defined as the centermost third of shroud 220 along its axial length. In other embodiments central portion 224 is defined as the centermost quarter of shroud 220 along its axial length. In still further embodiments central portion 224 is defined as the centermost tenth of shroud 220 along its axial length. In embodiments wherein mounting arm 278 extends axially forward from central portion 224, these various definitions of central portion 224 as either the centermost third, quarter, or tenth of shroud 220 provide for the various radial placements of mounting arm 278 relative to shroud 220.

Figure 6:
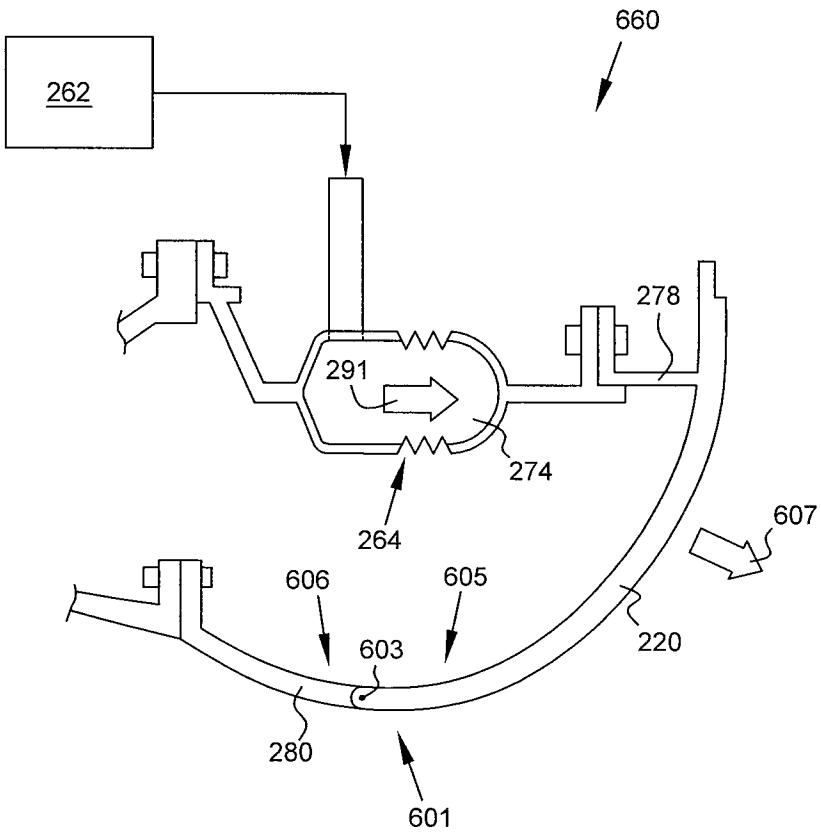
FIG. 6 is a schematic and sectional view of another embodiment of a clearance control system in accordance with the present disclosure.

FIG. 6 is a schematic and sectional view of another embodiment of a clearance control system 660 in accordance with the present disclosure. Clearance control system 660 has a hinged joint 601 comprising an annular pin 603 received by a forward portion 605 of shroud 220 and a receiving portion 606 of axial member 280.

As with the embodiment of FIG. 5, axial deflection of air piston 264 causes shroud 220 to deflect in a radially inward and axially aft direction as indicated by arrow 607. Axial deflection of air piston 264 caused by supplying high pressure air to piston chamber 274 results in axially aft movement of mounting arm 278. With a hinged joint 601, shroud 220 pivots about the annular pin 603 causing motion in a radially inward and axially aft direction as indicated by arrow 607.

The present disclosure provides many advantages over previous systems and methods of controlling blade tip clearances. The disclosed clearance control systems allow for tightly controlling blade tip clearances, which are a key driver of overall compressor efficiency. Improved compressor efficiency results in lower fuel consumption of the engine. Further, utilizing compressor discharge as the high pressure gas source obviates the need to attach an actuator external to the compressor or engine. The use of an air piston provides for manufacturing the shroud from a rigid or primarily rigid material, with the piston chamber supplying axial deflection of the shroud. Additionally, the present disclosure eliminates the use of complicated linkages, significant weight penalties, and/or significant power requirements of prior art systems.

Although examples are illustrated and described herein, embodiments are nevertheless not limited to the details shown, since various modifications and structural changes may be made therein by those of ordinary skill within the scope and range of equivalents of the claims.

What is claimed is:

1. A compressor shroud assembly in a turbine engine, the compressor shroud assembly comprising:

a static compressor casing;

an air piston mounted to said casing, said air piston comprising a chamber adapted to receive actuating air;

an aft extending mounting arm coupled to said air piston, wherein said aft extending mounting arm moves axially while maintaining a radial alignment when said air piston is actuated; and an impeller shroud for encasing a rotatable centrifugal compressor, the impeller shroud coupled at a forward end to said casing by a slidable coupling that maintains an air boundary during the full range of axial movement of said impeller shroud, the impeller shroud mounted proximate an aft end to said aft extending mounting arm, said impeller shroud moving relative to the rotatable centrifugal compressor in an axial direction while maintaining a radial alignment when said air piston is actuated.

2. The compressor shroud assembly of claim 1 wherein said air piston chamber is adapted to receive air from the discharge of the rotatable centrifugal compressor.

3. The compressor shroud assembly of claim 1 wherein said air piston comprises a forward rigid member mounted at a forward end to said casing, an aft rigid member coupled at an aft end to said mounting arm, and a flexible member coupling said forward and aft rigid members to thereby form said air piston chamber.

4. The compressor shroud assembly of claim 3 wherein said flexible member comprises a hoop having a U-shaped cross section.

5. The compressor shroud assembly of claim 3 wherein said flexible member comprises a bellows forming a hoop.

6. The compressor shroud assembly of claim 1 further comprising a chamber bounded in part by said casing and at least a portion of the impeller shroud proximate the aft end thereof, said chamber being pressurized by exducer air.

7. The compressor shroud assembly of claim 1 further comprising a chamber bounded in part by said casing and at least a portion of said impeller shroud proximate the forward end thereof, said chamber being pressurized by inducer air.

8. The compressor shroud assembly of claim 1 further comprising one or more sensors for measuring the air pressure in said air piston chamber, said air piston being actuated or vented in response to the measured pressure in said air piston chamber.

9. The compressor shroud assembly of claim 1 further comprising one or more sensors for measuring the clearance gap between said impeller shroud and the rotatable centrifugal compressor, said air piston being actuated or vented in response to the clearance gap measure by the one or more sensors.

10. A compressor shroud assembly in a turbine engine, the compressor shroud assembly comprising:

a static compressor casing;

an air piston mounted to said casing, said air piston comprising a chamber adapted to receive actuating air;

an aft extending mounting arm coupled to said air piston, wherein said aft extending mounting arm moves axially while maintaining a radial alignment when said air piston is actuated;

an impeller shroud for encasing a centrifugal compressor, the impeller shroud mounted at a forward end to said casing and mounted proximate an aft end to said aft extending mounting arm, said impeller shroud moving relative to the rotatable centrifugal compressor in a cantilevered manner from said forward end thereof when said air piston is actuated, said impeller shroud moving radially inward and axially aft at a central portion of the impeller shroud; and a chamber bounded in part by said casing and at least a portion of said impeller shroud, wherein said air piston and said aft extending mounting arm are disposed within said chamber.

11. The compressor shroud assembly of claim 10 wherein said air piston chamber is adapted to receive air from the discharge of the rotatable centrifugal compressor.

12. The compressor shroud assembly of claim 10 wherein said air piston comprises a forward rigid member mounted at a forward end to said casing, an aft rigid member coupled at an aft end to said mounting arm, and a flexible member coupling said forward and aft rigid members to thereby form said air piston chamber.

13. The compressor shroud assembly of claim 12 wherein said flexible member comprises a hoop having a U-shaped cross section.

14. The compressor shroud assembly of claim 12 wherein said flexible member comprises a bellows forming a hoop.

15. A method of dynamically changing a clearance gap between a rotatable centrifugal compressor and an impeller shroud encasing the rotatable centrifugal compressor, said method comprising:

mounting a pressure-actuated piston to a static casing;

mounting the impeller shroud to the piston, the impeller shroud slidably coupled to the casing; and actuating the piston to thereby move the impeller shroud relative to a rotatable centrifugal compressor, wherein the slidable coupling between said impeller shroud and said casing maintains an air boundary during the full range of axial movement of said impeller shroud.

16. The method of claim 15 further comprising providing air from the discharge of the rotatable centrifugal compressor to actuate the piston.

17. The method of claim 16 further comprising slidably coupling the forward end of the impeller shroud to the casing, wherein the impeller shroud moves relative to the rotatable centrifugal compressor in an axial direction while maintaining a radial alignment when the piston is actuated.

18. The method of claim 15 further comprising sensing the fluid pressure in an actuating chamber of the piston and actuating the piston in response to the sensed fluid pressure.

19. The method of claim 15 further comprising sensing the clearance gap between the rotatable centrifugal compressor and the impeller shroud and actuating the piston in response to the sensed clearance gap.

* * * * *